United States Patent [19]

Puri

[11] Patent Number: 4,537,252

[45] Date of Patent: Aug. 27, 1985

[54] METHOD OF UNDERGROUND CONVERSION OF COAL

[75] Inventor: Rajen Puri, Tulsa, Okla.

[73] Assignee: Standard Oil Company (Indiana), Chicago, Ill.

[21] Appl. No.: 572,737

[22] Filed: Jan. 20, 1984

Related U.S. Application Data

[63] Continuation-in-part of Ser. No. 371,108, Apr. 23, 1982, abandoned.

[51] Int. Cl.[3] ..... E21B 43/247; E21B 43/30

[52] U.S. Cl. ..... 166/245; 166/259; 166/263; 166/272

[58] Field of Search ..... 166/245, 256, 258, 259, 166/261, 263, 266, 272, 303; 48/DIG. 6

[56] References Cited

U.S. PATENT DOCUMENTS

| | | | |
|---|---|---|---|
| 2,595,979 | 5/1952 | Pevere et al. | 166/272 X |
| 3,044,545 | 7/1962 | Tooke | 166/261 X |
| 3,379,248 | 4/1968 | Strange . | |
| 3,506,309 | 4/1970 | Von Hippel | 166/272 X |
| 3,809,159 | 5/1974 | Young et al. | 166/258 |
| 3,948,320 | 4/1976 | Terry | 166/272 |
| 3,952,802 | 4/1976 | Terry | 166/261 X |
| 4,010,800 | 3/1977 | Terry | 166/258 |
| 4,018,481 | 4/1977 | Terry | 166/261 X |
| 4,057,293 | 11/1977 | Garrett | 166/263 X |
| 4,067,390 | 1/1978 | Camacho et al. | 166/302 |
| 4,243,101 | 1/1981 | Grupping | 166/258 X |
| 4,306,621 | 12/1981 | Boyd et al. | 166/245 |
| 4,386,657 | 6/1983 | Kiss et al. | 166/261 |
| 4,440,224 | 4/1984 | Kreinin et al. | 166/261 X |
| 4,448,252 | 5/1984 | Stoddard et al. | 166/258 X |

FOREIGN PATENT DOCUMENTS

| | | | |
|---|---|---|---|
| 1113001 | 11/1981 | Canada | 166/256 |

*Primary Examiner*—George A. Suchfield

*Attorney, Agent, or Firm*—Scott H. Brown; Robert R. Cochran

[57] ABSTRACT

A method of converting coal and other solid carbonaceous material to gaseous and liquid products by heating the coal in the presence of the gaseous effluent to a sufficient temperature for pyrolyzing the coal to produce liquid and gaseous products. Thereafter, further gasifying the coal to produce a gaseous effluent to be used in subsequent steps to produce liquid and gaseous products.

5 Claims, 8 Drawing Figures

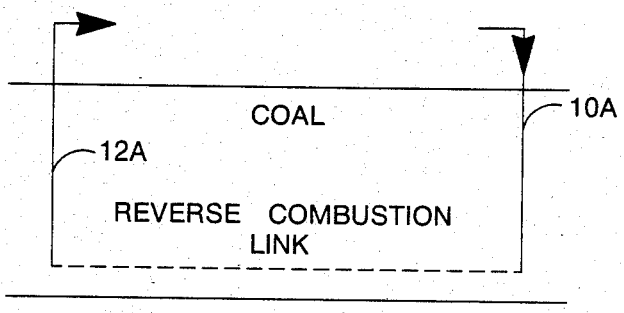
FIGURE 2-A
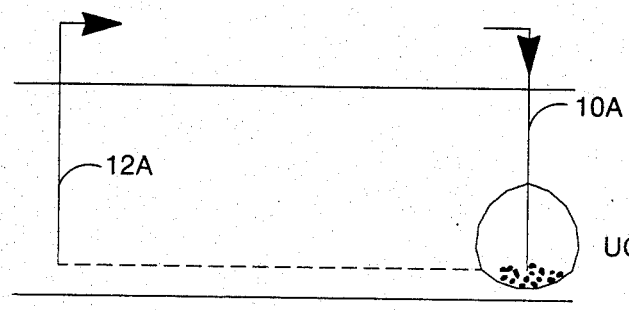
FIGURE 2-B
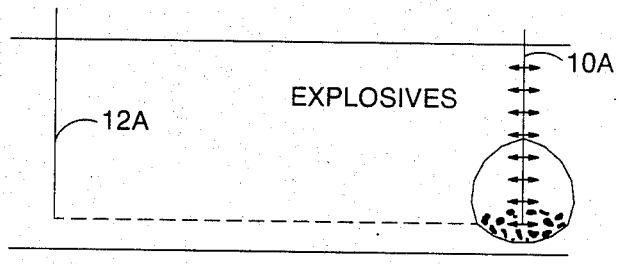
FIGURE 2-C
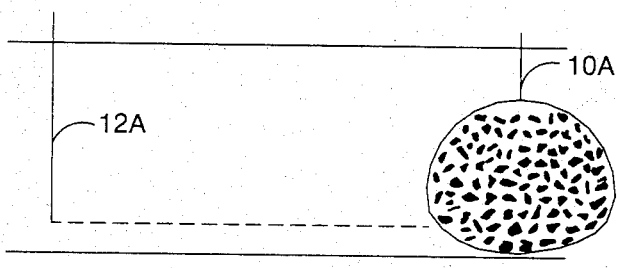
FIGURE 2-D
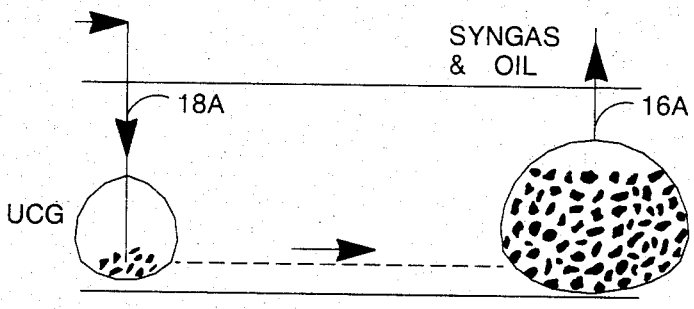
FIGURE 2-E

METHOD OF UNDERGROUND CONVERSION OF COAL

CROSS REFERENCE TO RELATED APPLICATIONS

This application is a continuation-in-part of application Ser. No. 371,108, filed Apr. 23, 1982, now abandoned.

BACKGROUND OF THE INVENTION

1. Field of the Invention

The present invention relates to a method of underground production of gaseous and liquid products from coal and, more particularly, to such a method which utilizes a portion of hot gaseous products from a previous gasification of the coal in a subsequent pyrolysis of the coal.

2. Setting of the Invention

Various methods of underground conversion of coal have been developed and are presently being experimentally utilized. Two of such methods are coal gasification and coal liquefaction. Underground Coal Gasification (UCG) involves pyrolysis of coal and other solid carbonaceous material to produce gaseous products, such as $H_2$, $CO_2$ and CO, and char. The char is gasified in the endothermic reaction of carbon with $H_2O$ or $CO_2$ at over 1400° F. to produce $H_2$, CO or $CO_2$, along with ash. To provide the heat energy necessary to carry out these reactions, an oxidant, such as oxygen or air, can be injected through a wellbore into a coal seam through a wellbore and a combustion zone is initiated in the coal seam which progresses through the coal seam. The combustion zone may move towards the oxidant source as in reverse combustion or may move away from the oxidant source as in forward combustion. The produced gases can thereafter be removed through a separate wellbore. These gases may be used as boiler fuel or transformed into methanol ($CH_3OH$) by methods well known in the industry. Coal gasification also produces liquid hydrocarbons, which are highly desirable for their Btu content. However, the amount of liquid hydrocarbons produced by these prior art methods of UCG is small. In underground coal gasification, over 92% of the potential energy in the coal can be recovered at the surface, with combustible gases accounting for about 65% of the total energy produced. However, about 23% of the total recovered energy is in the form of sensible heat of gas and latent heat of vaporization for any steam produced. In the prior art methods, this heat energy from the product gases has not been used and was dissipated.

Direct liquefaction of coal by in situ hydrous pyrolysis is another method of recovering energy from coal and solid carbonaceous material. Hydrous pyrolysis produces gaseous and liquid hydrocarbons in a pyrolysis reaction with coal and water, usually steam, at over 700° F. The liquid hydrocarbons produced are considered high quality because the liquid product is more saturated and paraffinic. In this process, steam is percolated through a coal seam to produce liquid hydrocarbons; however, large quantities of heat energy are required to be injected to heat the coal directly or to heat any water present to produce the steam necessary for the pyrolysis reaction.

There exists a need for the production and recovery of liquid hydrocarbons from conversion of coal and solid carbonaceous material by a method which does not have the heat energy generation requirements of conventional liquefaction of coal, as by using waste energy from another location or process.

One such method for using waste energy is disclosed in U.S. Pat. No. 3,379,248 to Strange. In the patent to Strange, water is injected into a heated formation which is traversed by a combustion zone. The water is heated to produce steam and is recovered at the surface where the heat energy of the produced steam is used to move fluids between the surface and a second portion of the formation. Strange, however, does not disclose recovering gaseous products from a coal gasification process and utilizing the heat energy therein for the liquefaction of coal to produce liquid hydrocarbons.

U.S. Pat. No. 4,057,293 to Garrett discloses a method of liquification of coal wherein pyrolysis is initiated in one portion of a retorting area and oil and gas is withdrawn from another portion, and thereafter the flow of produced gas in the retorting area is reversed to convert any produced char into a gaseous product.

U.S. Pat. No. 4,010,800 to Terry discloses a method of extracting gaseous effluent from a coal bed by performing a gasification process in one coal seam and diverting the hot gases produced therefrom to a second coal seam. The second coal seam is thereby dried and pyrolyzed and resulting gaseous effluents are collected at the surface. Garrett and Terry do not disclose or suggest a method of simultaneously producing liquid and gaseous products from coal and other solid carbonaceous material by liquefying fresh coal with hot gases generated by gasifying another portion of the coal that previously had been liquefied.

SUMMARY OF THE INVENTION

The present invention is a novel process for the underground conversion of coal and other solid carbonaceous material to gaseous and liquid products. In the process, injection and production wells are linked together (by reverse combustion or other known methods) and the coal liquefied by flowing hot syngas through it. Hot syngas is generated in another portion of the coal seam that had previously been liquefied. The transfer of hot syngas from one portion of the coal seam to another can be done in situ via permeable links, or by bringing it to the surface and then reinjecting it back underground. In one embodiment of the present invention, the gasification and liquefaction of the coal can be conducted sequentially through a plurality of groupings of pairs of wells which penetrate the coal formation. By this, the process can be advanced across the formation from one grouping of pairs of wells to another.

BRIEF DESCRIPTION OF THE DRAWINGS

FIGS. 2A–E are diagrammatic representations of one process to create a rubbled coal bed for use in the present invention.

DETAILED DESCRIPTION OF THE PREFERRED EMBODIMENTS

Figure 1:
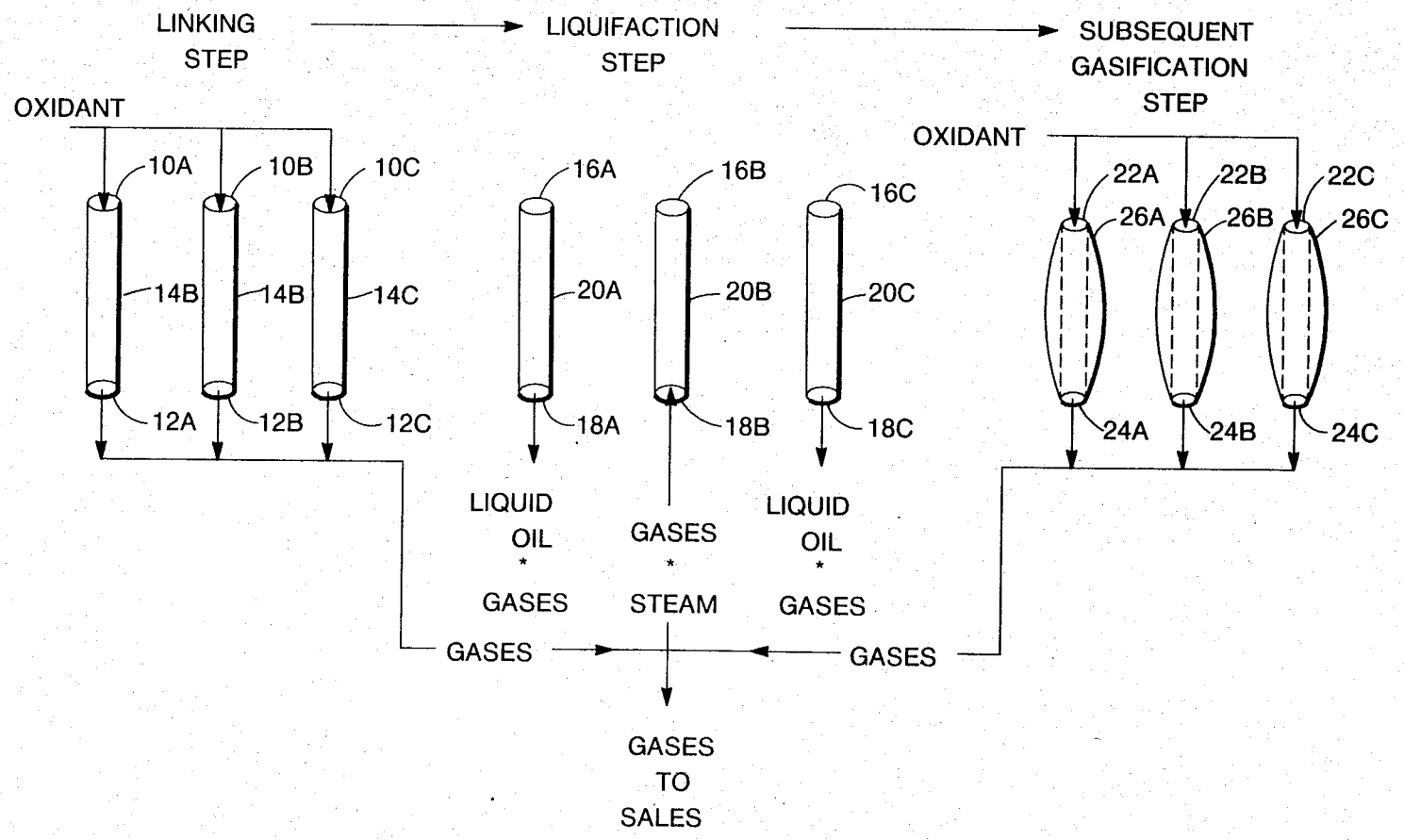
FIG. 1 is a semi-diagrammatic plan view of a plurality of spaced wells illustrating the three sections of the methods described within the present invention.

The present invention is for a coal conversion process for the production of liquid and gaseous hydrocarbon products in an energy efficient manner. In the present invention, fresh coal and other solid carbonaceous material (either in situ or contained in retorting vessels above ground) is heated with hot syngas to sufficient temperatures for the pyrolysis of coal. The hot syngas is generated by gasifying another part of the coal seam where liquefaction had previously been conducted. The method of the present invention can be sequentially initiated in a plurality of wells which penetrate a coal seam so that the heat energy from a previous gasification step can be utilized in subsequent liquefaction steps.

To aid in the understanding of the method of the present invention, the following definitions are provided.

Coal gasification involves the conversion of carbonaceous material to produce $H_2$, $CO_2$, CO, liquid hydrocarbons and char. Char gasification is an endothermic reaction (at over 1400° F.) with $H_2O$ or $CO_2$ to produce $H_2$, $CO_2$ or CO.

Combustion is a chemical reaction which produces heat energy and light by reaction of carbon with oxygen.

Hydrous pyrolysis is the pyrolysis of carbonaceous material with sufficient $H_2O$ at over 700° F. to produce liquid and gaseous hydrocarbon products.

Syngas shall mean the hot gaseous products produced by coal combustion, liquefaction, and gasification and can include steam.

In one embodiment of the present invention, a plurality of spaced wells are drilled to penetrate an underground coal seam. The wells are spaced to have a grouping of at least two pairs of wells, with each pair of wells being adjacent to and parallel with the other pair. In this embodiment, a highly permeable link is established between the wells by means of reverse combustion. After this step has been completed, the coal between the adjacent links is pyrolyzed to produce liquid and gaseous products by flowing hot syngas through it. Hot syngas is obtained by the gasification of coal left behind during a previous liquefaction step. In this manner, the process is advanced across the field of wells. In this process, coal between the first pair of wells involved in liquefaction is heated by the injection of a portion of the gaseous products produced from an adjacent pair of wells being simultaneously gasified. The liquid products are recovered and used or sold. Thereafter, the gasification step is initiated between an adjacent pair of wells which have immediately had the liquefaction step initiated there between. In this embodiment, the gasification and liquefaction steps are advanced one right after the other across a field of spaced pairs of wells. Also, gaseous products recovered in a liquification step can be utilized in subsequent liquefactions, thus efficiently using the heat energy which would otherwise be lost. By this process, liquid hydrocarbons are produced in a more energy efficient manner and gaseous products are also produced and recovered for use or sale.

The wells which penetrate the coal seam are drilled in any commercially available manner and can be completed as required to protect water tables, underground aquifers, or other formations. The wells can be drilled anywhere from about 30 to more than 200 feet apart, preferably between about 70 and about 100 feet apart.

As discussed above and as shown in FIG. 1, the wells are spaced in pairs and in rows, but can be drilled in any suitable pattern, such as a five-spot pattern. As shown in FIG. 1, each grouping having at least two pairs of wells has a first well 10 and a second well 12. To initiate one method of this invention, an oxygen-containing gas, such as oxygen or air, is injected into a plurality of wells 10A, B, and C, such as the set of three wells labeled "Linking Step" in FIG. 1, and combustion zones, initiated at the corresponding wells 12A, B and C, are advanced towards the source of oxygen-containing gas (wells 10A, B and C) by a reverse combustion process to link the wells. The combustion zones produce narrow char channels 14A, B and C, respectively, each about three feet in diameter. The gaseous products produced, hereinafter referred to as syngas, are removed through the wells 12A, B and C, respectively, by known methods. After the wells 10A, B and C and 12A, B and C have been connected by the channels 14A, B and C, then the linking step is initiated at an adjacent set of wells. In this manner, the set of wells labeled "Linking Step" become the set of wells labeled "Liquefaction Step". The process of the present invention advances across a field of wells, and as shown in FIG. 1, from left to right.

As the linking step is initiated at an adjacent set of wells, the wells 10A, B and C and 12A, B, and C used previously for linking but now used for liquefaction (labeled "Liquefaction Step"), and now renumbered 16A, B and C, are blocked and hot syngas (at about 1000° F.) is injected under suitable pressure into a central well 18B of the three wells labeled "Liquification Step." The hot syngas under pressure percolates sideways or outward from the channel 20B to the other channels 20A and C on either side. The injected hot syngas produces liquid hydrocarbons within the coal by hydrous pyrolysis and hydrogenation and can produce char. The injected syngas together with the produced liquid hydrocarbons flow into the channels 20A and C and are removed through the production wells 18A and C by known methods. If additional water or steam is needed to carry out the hydrous pyrolysis at an efficient rate, water or steam may be introduced into the coal seam with the syngas into the well 18B.

After the liquefaction step has been completed on the wells 16A, B and C and 18A, B and C, the linking step is initiated at a new set of wells and the liquefaction step is initiated at the wells which have immediately been used for the linking step. Also, a subsequent gasification step is initiated at the pairs of wells which have immediately been used for the liquefaction step. In the subsequent gasification step, the wells 16A, B and C (but now renumbered 22A, B and C in the set of wells labeled "Subsequent Gasification Step") are opened and oxygen-containing gas is injected under pressure through the wells 22A, B and C. A combustion zone is initiated at the wells 22A, B and C and are advanced through the channels by forward combustion to gasify any remaining carbonaceous material, usually char. The syngas produced as a result of the gasification in the subsequent gasification step is recovered through the wells 24A, B and C. In the subsequent gasification step, cavities 26A, B and C are formed in the coal seam. A portion of the hot syngas from the subsequent gasification step is then introduced back into the adjacent well 18B (being utilized for the liquefaction step), along with the hot syngas from a concurrent or previous linking step, as shown by the flow lines in FIG. 1.

Once this method of the present invention is fully in operation, the first linking step, the liquefaction step and the subsequent gasification step are simultaneously advanced across the field of wells. The steps are advanced such that the sensible energy of the syngas produced during gasification is recovered and utilized for liquefaction. The liquid products produced in liquefaction step can be recovered and utilized as boiler fuel, or used as petrochemical/petroleum feedstock.

An alternate method could be employed for the simultaneous in situ gasification and liquefaction of coal. The hot syngas produced during gasification could be directly channeled to the liquefaction zones by means of permeable underground links. The process scheme is shown in FIGS. 2A–E, wherein (in FIG. 2A) the wellbores 10A and 12A, for example, are drilled through and into the coal seam. Thereafter, a permeable link is established near the bottom boundary of the coal seam by hydraulic fracturing, acidizing, or by a reverse combustion process. A gasification process is initiated (FIG. 2B) and continued until a cavity has been created. Explosive devices are then placed along the length of the injection well 10A and within the cavity (FIGS. 2C). Upon detonation, the resulting shock waves would rubblize the coal around the wellbore 10A and fills the cavity with rubbled coal (FIG. 2D). Thereafter, the injection of the oxygen containing gas is initiated through the wellbore 18A (previously wellbore 12A in the gasification step). The temperature of the rubbly coal increased and it begins to pyrolyze to produce liquid and gaseous hydrocarbons and syngas for use, as described here in this discussion.

The methods described above are an improvement over any known in situ methods for recovering energy from coal, because substantial amounts of valuable liquid hydrocarbons are produced together with syngas in a method which does not waste the heat energy of the syngas, thereby reducing the energy requirements for coal liquefaction.

Utilizing the published information on in situ coal gasification, it is estimated that over fifteen times more energy in the form of sensible and latent heat would be available from the first and subsequent gasification steps than would be needed to heat the coal for liquefaction. Even if small thermal and gas losses are taken into consideration, the liquefaction of the coal can be initiated and sustained only on the heat energy from the first and subsequent gasification steps, which would have been otherwise wasted.

To prove that the thermal efficiency of the gasification steps used in the present invention is adequate to liquify the coal, the following calculations are provided. Using test data from Hanna II Phase II, DOE Underground Coal Gasification project at Hanna, Wyo.:

Duration of Test=25 Days
Coal Consumed=2500 Tons
Gas Rate=8.5×MMSCFD
BTU of Gas=171 BTU/SCF
9.4% of energy in coal is as sensible heat of gas.
14.0% of energy in coal is as steam.
65.1% of energy in coal is as combustible gas.

And, assuming that all of the energy from the first and subsequent gasification steps is available to heat the coal to liquefaction temperatures (about 700° F.) and that 2500 tons of coal is contacted for liquefaction then the following calculations can be made.

Cp of coal=0.24 BTU/lb °F.

Q=Heat needed for heating the coal from 80° F. (ambient temp. in coal seam) to 700° F. (temp. needed for Section 2)

$Q=mCp\ (T_2-T_1)$

Q=2500 tons (2240 lbs/ton) (0.24 BTU/lb °F.)(700°–8020 F.)

Q=0.8333 Billion BTU

Now, solving the heat energy available as sensible heat and steam for liquefaction in Step B from the coal gasification steps.

$Q_L$=(Gas BTU) (Gas Rate)(gas % energy+steam % energy)/((combustible gas % energy) (duration))

$Q_L$=171 BTU/SCF ($8.5\times10^6$ SCF/D) (9.4+14)/(65.1)(25 days)

$Q_L$=13.06 Billion BTU

Therefore, the heat energy retained from the coal gasification steps available for use in the liquefaction steps is 15.6 times greater than the heat energy required to liquefy the coal.

There are several other advantages to this embodiment of present invention. The gasification process in the subsequent gasification step advances through an already hot, permeable char bed produced in the liquefaction step which can be more efficient than through a cold, relatively impermeable coal seam. With the volatile products of the coal removed during the coal liquefaction, the problems associated with tar condensation during conventional in situ coal gasification will be minimized. Further, the residence time of the gases and the temperature of the liquefaction in the liquefaction step can be controlled by controlling the temperatures and rates of the injected syngas from the first and subsequent gasification steps, and steam.

The heat energy needed to gasify the coal in the gasification step and/or the subsequent gasification step can be provided by radiant heaters placed through the wells 10A, B and C and 22A, B and C, or the wells 12A, B and C and 24A, B and C, to heat the coal to gasification temperatures. The radiant heaters may be electrical resistance or arc heaters, or catalytic combustion heaters. Also, electrical induction heaters may be placed in the coal seam to gasify the coal, as well as microwave heaters to directly heat the coal to gasification temperatures.

Figure 3:
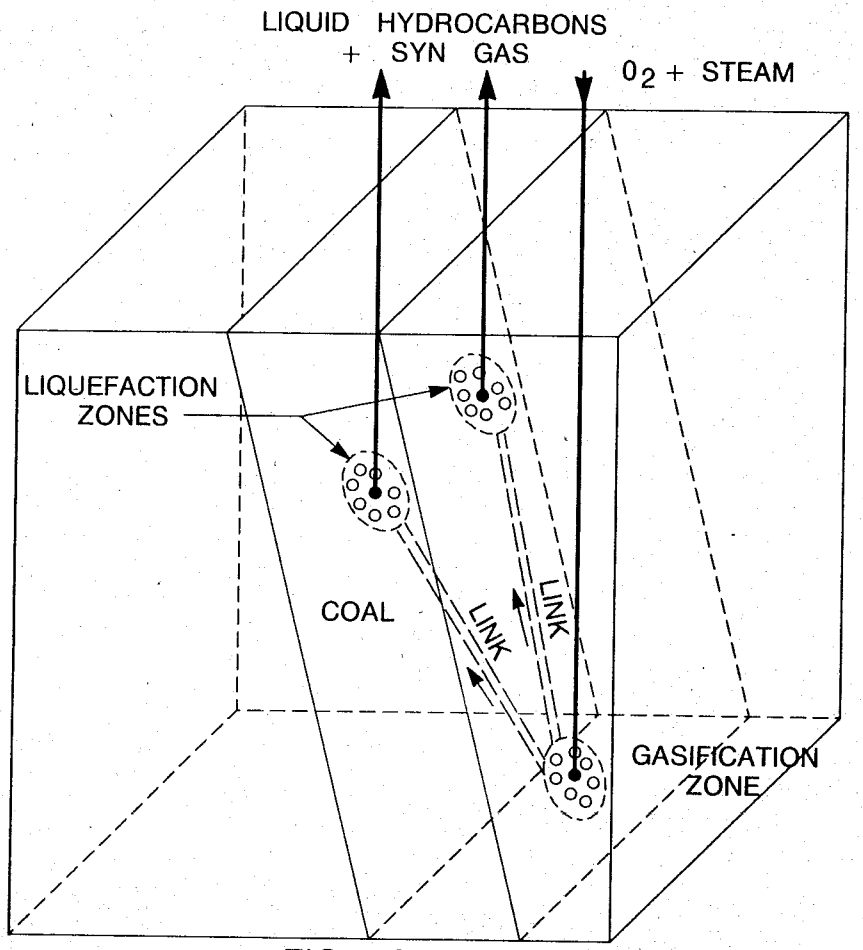
FIG. 3 is a semi-diagrammatic representation of an alternate embodiment of the present invention applied to a steeply dipping coal bed.
Figure 4:
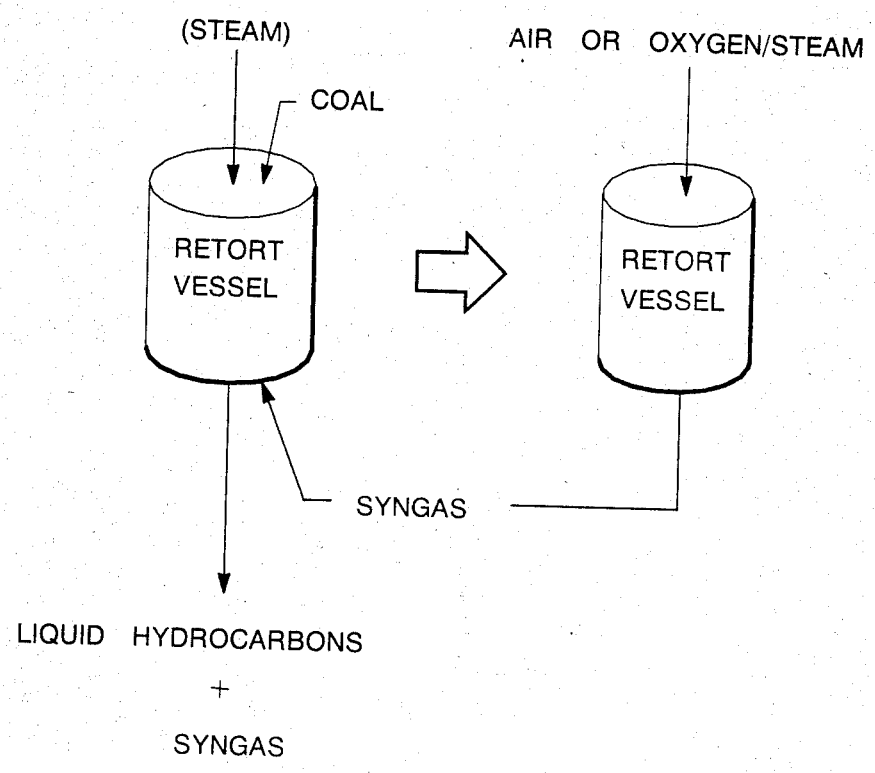
FIG. 4 is a semi-diagrammatic representation of an alternate embodiment of the present invention.

The methods of the present invention can be used on steeply dipping coal beds, such as shown in FIG. 3. First, a plurality of wells are drilled into the inclined coal seam or bed either vertically or at an incline. These wells are then linked together by way of reverse combustion or directional drilling. The coal adjacent the end of the production well is rubbled by using explosives or forward combustion induced roof collapse (as described earlier). A gasification process is initiated at the injection well by introducing an oxygen containing gas and steam into the coal bed. Any syngas which is generated channels to the rubbly coal bed near the production well(s). The hot syngas liquefies (or pyrolyzes) the rubbly coal at over 350° C. If high pressure (4000–5000 psig) is maintained, and the temperature is about 550° C., as much as 90 wt % of moisture and ash-free (MAF) coal is converted to liquid and gaseous products. Conversion is lower at lower pressures and temperatures. Depending on the coal type and process conditions, 30–90 MAF wt % product yield could be expected.

Any produced liquid hydrocarbons are then recovered through a production well or wells and separated at the surface. Due to the roof collapse, fresh coal is continuously fed to the gasification and liquefaction cavities. At an appropriate time, the production well(s) is made into an injection well and the process continued by drilling new injection wells to advance the process across a coal bed, as described herein.

One of the keys to successful application of this process is to control the reaction conditions in the liquefaction zones. The necessary pressure can be reached in situ by operating this process at an approximate depth. The temperature of the syngas near the end of the production well will be about 1,500° C., and the syngas will lose some heat as it flows to the production well(s). However, the temperature of the liquefaction zone can be controlled by injecting steam and/or water into the liquefaction zone through a stringer placed within the wellbore(s). Further, if desired, the production well(s) and the injection well(s) can be reversed so that the produced fluid flow in the coal bed can flow either up the bed or down the bed.

In an alternate embodiment of the present invention, pulverized coal is introduced into aboveground retort vessels. The coal is heated to liquefaction temperatures, over 350° C., by means of hot syngas. The hot syngas needed is generated by gasifying coal which had preciously been subjected to liquefaction. Consequently, liquefaction and gasification steps will be carried out sequentially and simultaneously. The otherwise wasted heat of syngas would therefore be effectively utilized for liquefaction. The coal in the gasification steps may be heated by combustion thereof or direct or radiant heating.

As can be understood from the discussion above and from viewing the drawings, a novel process is provided to produce and recover liquid and gaseous products from coal or other solid carbonaceous material in a manner which is energy efficient.

Whereas the present invention has been described in particular relation to the drawings attached hereto, it should be understood that other and further modifications, apart from those shown or suggested herein, may be made within the scope and spirit of this invention.

What is claimed is:

1. A method of converting to gaseous and liquid products coal and other solid carbonaceous material contained in a coal seam provided with a plurality of well groupings, each grouping comprising at least two pairs of wells comprising the steps of:

(a) injecting an oxygen containing gas into at least a pair of wells in a grouping;

(b) initiating combustion between said first pair of wells in said grouping and a second pair of wells in said grouping, said combustion linking said wells and producing syngas;

(c) thereafter blocking wells into which oxygen was injected in step (a), thereby providing blocked wells;

(d) injecting syngas and steam into a well in said first grouping linked to a blocked well in said grouping and removing liquid and gaseous products from at least one adjacent well in said first grouping, thereby leaving char;

(e) unblocking wells blocked in step (c) in said first grouping and introducing an oxygen containing gas into said wells to gasify coal and char therein by combustion;

(f) removing syngas from wells in communication with wells having oxygen injected thereinto in step (e); and (g) repeating the sequence of steps (a) to (e) in a subsequent grouping of wells and utilizing a portion of the syngas produced in the steps (b) and (f) as the feed to step (d) carried out in said subsequent grouping.

2. The method of claim 1 wherein step (b) is accomplished by reverse combustion.

3. The method of claim 1 wherein step (e) is accomplished by forward combustion.

4. The method of claim 1 wherein the coal seam is inclined.

5. The method of claim 1 wherein the coal is rubbled prior to step (d).

* * * * *